US012544634B1

(12) United States Patent
Hoffarth et al.

(10) Patent No.: US 12,544,634 B1
(45) Date of Patent: Feb. 10, 2026

(54) WEDGE SLIDER WEIGHT FOR GOLF CLUB HEAD

(71) Applicant: Topgolf Callaway Brands Corp., Carlsbad, CA (US)

(72) Inventors: Brian Hoffarth, Carlsbad, CA (US); Michael Hallack, Carlsbad, CA (US); Homer Aguinaldo, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 219 days.

(21) Appl. No.: 18/629,607

(22) Filed: Apr. 8, 2024

(51) Int. Cl.
*A63B 53/04* (2015.01)
*A63B 60/04* (2015.01)

(52) U.S. Cl.
CPC ..... *A63B 53/0466* (2013.01); *A63B 60/04* (2015.10); *A63B 2053/0491* (2013.01)

(58) Field of Classification Search
CPC ..... A63B 53/0466; A63B 2053/0491
USPC ..... 473/334
See application file for complete search history.

(56) References Cited

U.S. PATENT DOCUMENTS 5,197,349 A 3/1993 Herman
5,244,205 A 9/1993 Baltronis et al.
5,769,737 A * 6/1998 Holladay ..... A63B 53/06 473/340
6,475,100 B1 11/2002 Goodjohn et al.
6,860,818 B2 3/2005 Mahaffey et al.
6,890,267 B2 5/2005 Greene et al.
6,988,960 B2 1/2006 Mahaffey et al.
7,086,962 B2 8/2006 Galloway et al.
7,097,573 B2 8/2006 Erickson et al.
7,115,041 B2 10/2006 Guard et al.
7,115,046 B1 10/2006 Evans
7,115,047 B2 10/2006 Stevens et al.
7,121,955 B2 10/2006 Stevens et al.
7,121,957 B2 10/2006 Hocknell et al.
7,125,344 B2 10/2006 Hocknell et al.
7,128,661 B2 10/2006 Soracco et al.
7,144,333 B2 12/2006 Murphy et al.
7,144,336 B2 12/2006 Reyes et al.
7,147,569 B2 12/2006 Tang et al.
7,147,573 B2 12/2006 DiMarco
7,147,575 B2 12/2006 Galloway et al.
7,166,041 B2 1/2007 Evans
7,252,600 B2 8/2007 Murphy et al.
7,255,654 B2 8/2007 Murphy et al.
7,278,927 B2 10/2007 Gibbs et al.
7,311,613 B2 12/2007 Stevens et al.
7,314,418 B2 1/2008 Galloway et al.
7,338,387 B2 3/2008 Nycum et al.
7,344,451 B2 3/2008 Tang et al.
7,354,353 B2 4/2008 Hocknell et al.
7,381,041 B2 6/2008 Wilber
7,387,577 B2 6/2008 Murphy et al.
7,396,296 B2 7/2008 Evans
(Continued)

*Primary Examiner* — John E Simms, Jr.
(74) *Attorney, Agent, or Firm* — Michael A. Catania

(57) ABSTRACT

A weight assembly for a golf club head is disclosed herein. The weight assembly includes a screw, a first wedge, a second wedge, and a nut component. The first wedge and the second wedge are designed to convert a downward force of the screw into a side force to push the first wedge and the second wedge outward to lock the weight assembly within a channel of a golf club head by the first wedge and second wedge extending force against the interior walls.

20 Claims, 19 Drawing Sheets

(56) References Cited

U.S. PATENT DOCUMENTS 7,396,300 B2 7/2008 Kennedy et al.
7,402,114 B2 7/2008 Binette et al.
7,407,448 B2 8/2008 Stevens et al.
7,413,520 B1 8/2008 Hocknell et al.
7,431,667 B2 10/2008 Vincent et al.
7,438,647 B1 10/2008 Hocknell
7,452,283 B2 11/2008 Hettinger et al.
7,491,134 B2 2/2009 Murphy et al.
7,491,135 B1 2/2009 Rollinson
7,497,787 B2 3/2009 Murphy et al.
7,520,820 B2 4/2009 DiMarco
7,540,810 B2 6/2009 Hettinger et al.
7,549,935 B2 6/2009 Foster et al.
7,582,248 B2 9/2009 Reyes et al.
7,637,822 B2 12/2009 Foster et al.
7,648,426 B2 1/2010 Evans
7,677,987 B2 3/2010 Hilton
7,708,652 B2 5/2010 Cackett et al.
7,713,143 B2 5/2010 Evans
7,717,803 B2 5/2010 DiMarco
7,717,807 B2 5/2010 Evans et al.
7,749,096 B2 7/2010 Gibbs et al.
7,749,097 B2 7/2010 Foster et al.
7,794,334 B2 9/2010 Hilton
7,811,181 B2 10/2010 Galloway et al.
7,828,673 B2 11/2010 Evans
7,828,675 B2 11/2010 Hilton
7,837,577 B2 11/2010 Evans
7,846,038 B2 12/2010 Foster et al.
7,934,999 B2 5/2011 Cackett et al.
7,938,741 B2 5/2011 Evans
8,012,034 B1 9/2011 Cackett et al.
8,123,626 B2 2/2012 Cackett et al.
8,197,357 B1 6/2012 Rice et al.
8,197,358 B1 6/2012 Watson et al.
8,221,258 B2 7/2012 Cackett et al.
8,235,843 B1 8/2012 Rice et al.
8,246,488 B2 8/2012 Stevens et al.
8,262,496 B1 9/2012 Cackett et al.
8,262,506 B2 9/2012 Watson et al.
8,328,661 B1 12/2012 Erickson
8,337,327 B2 12/2012 Dawson et al.
8,337,328 B2 12/2012 Foster et al.
8,403,770 B1 3/2013 Aguinaldo et al.
8,414,420 B1 4/2013 Erickson
8,414,422 B2 4/2013 Peralta et al.
8,425,344 B2 4/2013 Evans et al.
8,444,506 B2 5/2013 Watson et al.
8,485,919 B2 7/2013 Rice et al.
8,517,851 B2 8/2013 Cackett et al.
8,540,588 B2 9/2013 Rice et al.
8,550,934 B2 10/2013 Evans
8,579,724 B2 11/2013 Evans
8,641,554 B1 2/2014 Hocknell
8,663,030 B2 3/2014 Evans
8,668,596 B2 3/2014 Cackett et al.
8,684,859 B1 4/2014 Aguinaldo et al.
8,690,708 B1 4/2014 Ehlers
8,696,486 B1 4/2014 Aguinaldo et al.
8,696,491 B1 4/2014 Myers
8,702,533 B2 4/2014 Evans
8,715,102 B1 5/2014 Aguinaldo et al.
8,715,103 B1 5/2014 Aguinaldo et al.
8,715,104 B1 5/2014 Wall et al.
8,715,106 B1 5/2014 Seluga et al.
8,727,899 B1 5/2014 Galloway
8,727,906 B1 5/2014 Aguinaldo et al.
8,753,221 B1 6/2014 Aguinaldo et al.
8,753,226 B2 6/2014 Rice et al.
8,777,774 B1 7/2014 Kim
8,790,195 B1 7/2014 Myers et al.
8,801,537 B1 8/2014 Seluga et al.
8,834,294 B1 9/2014 Seluga
8,852,019 B2 10/2014 Wall et al.
8,858,362 B1 10/2014 Leposky
8,870,674 B1 10/2014 Abbott
8,894,506 B1 11/2014 Myers
8,911,304 B1 12/2014 Dawson et al.
8,915,797 B1 12/2014 Kuhar
8,956,243 B2 2/2015 Kim et al.
8,956,244 B1 2/2015 Seluga
8,968,116 B1 3/2015 Myers
8,979,671 B1 3/2015 DeMille
9,022,881 B1 5/2015 Ehlers
9,044,652 B2 6/2015 Aguinaldo et al.
9,067,108 B2 6/2015 Aguinaldo et al.
9,067,110 B1 6/2015 Seluga
9,072,951 B1 7/2015 Tang
9,084,921 B1 7/2015 Liang et al.
9,101,806 B1 8/2015 Aguinaldo et al.
9,101,811 B1 8/2015 Goudarzi
9,108,091 B1 8/2015 Kim
9,119,998 B1 9/2015 Wall et al.
9,155,943 B2 10/2015 Seluga et al.
9,168,427 B1 10/2015 Aguinaldo et al.
9,174,097 B1 11/2015 Dacey et al.
9,180,349 B1 11/2015 Seluga
9,192,829 B2 11/2015 Griffin
9,199,145 B1 12/2015 Myers
9,211,453 B1 12/2015 Foster
9,216,332 B1 12/2015 Ehlers
9,220,957 B1 12/2015 Myers et al.
9,227,117 B2 1/2016 Kim et al.
9,259,627 B1 2/2016 Myers et al.
9,289,660 B1 3/2016 Myers
9,308,423 B1 4/2016 Tang et al.
9,333,390 B1 5/2016 Manwaring
9,333,401 B2 5/2016 Rice et al.
9,333,404 B2 5/2016 Abbott et al.
9,333,410 B1 5/2016 Myers
9,345,936 B1 5/2016 Westrum
9,352,199 B2 5/2016 Seluga et al.
9,364,728 B1 6/2016 Myers
9,364,729 B2 6/2016 Myers
9,375,618 B2 6/2016 Myers et al.
9,387,373 B1 7/2016 DeMille
9,387,376 B1 7/2016 Hall
9,387,377 B2 7/2016 Liang
9,409,069 B2 8/2016 Ehlers
9,415,279 B2 8/2016 Foster
9,440,125 B1 9/2016 Myers
9,463,361 B2 10/2016 Goudarzi et al.
9,480,889 B1 11/2016 Abbott
9,486,677 B1 11/2016 Seluga
9,539,474 B2 1/2017 Dacey et al.
9,550,097 B1 1/2017 Myers et al.
9,561,404 B2 2/2017 Aguinaldo et al.
9,597,561 B1 3/2017 Seluga
9,623,294 B1 4/2017 Kingston et al.
9,623,302 B1 4/2017 Myers et al.
9,630,069 B2 4/2017 Foster et al.
9,636,551 B1 5/2017 Aguinaldo et al.
9,636,553 B1 5/2017 Myers
9,662,544 B2 5/2017 Foster
9,675,852 B2 6/2017 Westrum
9,675,856 B1 * 6/2017 Gibbs ..... A63B 53/047
9,682,288 B2 6/2017 Rice et al.
9,682,296 B1 * 6/2017 Myers ..... A63B 53/0466
9,682,298 B1 6/2017 Kingston et al.
9,682,299 B2 6/2017 Tang et al.
9,687,701 B1 6/2017 Seluga
9,694,256 B2 7/2017 Myers et al.
9,694,260 B1 7/2017 Abbott et al.
9,694,261 B2 * 7/2017 Nunez ..... A63B 60/52
9,694,262 B1 7/2017 Myers
9,707,459 B1 7/2017 Myers
9,713,752 B2 7/2017 Myers et al.
9,717,962 B1 8/2017 Seluga
9,724,577 B1 8/2017 Kingston et al.
9,731,175 B1 8/2017 Myers et al.
9,731,178 B1 8/2017 Myers
9,776,060 B2 10/2017 Hall et al.
9,782,642 B1 10/2017 DeMille et al.
9,782,646 B2 10/2017 Seluga et al.

(56) References Cited

U.S. PATENT DOCUMENTS

| | | | | |
|---|---|---|---|---|
| 9,814,954 | B2 | 11/2017 | Westrum | |
| 9,827,469 | B1 | 11/2017 | Seluga et al. | |
| 9,833,669 | B2 | 12/2017 | Myers et al. | |
| 9,839,823 | B2 | 12/2017 | Ehlers | |
| 9,844,716 | B2 | 12/2017 | Foster | |
| 9,849,350 | B2 | 12/2017 | Dacey et al. | |
| 9,849,359 | B2 | 12/2017 | Gibbs et al. | |
| 9,861,863 | B1 | 1/2018 | Ivanova | |
| 9,878,223 | B2 | 1/2018 | Foster et al. | |
| 9,908,019 | B1 | 3/2018 | Seluga | |
| 9,931,549 | B1 | 4/2018 | Seluga et al. | |
| 9,937,392 | B2 | 4/2018 | Myers et al. | |
| 9,956,462 | B2 | 5/2018 | Nunez et al. | |
| 9,962,583 | B2 | 5/2018 | Abbott et al. | |
| 9,968,834 | B1 * | 5/2018 | Seluga | A63B 53/0466 |
| 9,981,165 | B2 | 5/2018 | Goudarzi et al. | |
| 9,981,170 | B2 | 5/2018 | Myers | |
| 10,004,958 | B2 | 6/2018 | Tang et al. | |
| 10,010,771 | B2 | 7/2018 | Seluga et al. | |
| 10,022,602 | B2 | 7/2018 | Kingston et al. | |
| 10,058,745 | B2 | 8/2018 | Dacey et al. | |
| 10,065,085 | B2 | 9/2018 | Seluga | |
| 10,065,086 | B2 | 9/2018 | Seluga et al. | |
| 10,065,091 | B2 | 9/2018 | Hall et al. | |
| 10,076,687 | B2 | 9/2018 | Tomimbang et al. | |
| 10,076,690 | B2 | 9/2018 | Myers | |
| 10,076,691 | B1 | 9/2018 | Kingston | |
| 10,080,932 | B2 | 9/2018 | DeMille et al. | |
| 10,099,095 | B2 | 10/2018 | Myers | |
| 10,099,096 | B2 | 10/2018 | Seluga | |
| 10,137,332 | B1 | 11/2018 | Jeon | |
| 10,173,105 | B2 | 1/2019 | Myers et al. | |
| 10,173,108 | B2 | 1/2019 | Westrum et al. | |
| 10,173,110 | B1 | 1/2019 | Foster et al. | |
| 10,173,111 | B2 | 1/2019 | Busch et al. | |
| 10,213,663 | B2 | 2/2019 | Goudarzi et al. | |
| 10,238,933 | B1 | 3/2019 | Holt et al. | |
| 10,617,920 | B2 | 4/2020 | Nunez et al. | |
| 10,617,921 | B2 | 4/2020 | Busch et al. | |
| 11,925,841 | B2 * | 3/2024 | Yi | A63B 53/0466 |
| 2012/0231896 | A1 | 9/2012 | Seluga et al. | |
| 2018/0021641 | A1 * | 1/2018 | Hall | A63B 53/0466 473/335 |
| 2018/0311547 | A1 | 11/2018 | Busch et al. | |
| 2018/0318676 | A1 * | 11/2018 | Kingston | A63B 53/06 |
| 2019/0009143 | A1 | 1/2019 | Myers | |
| 2019/0192928 | A1 * | 6/2019 | Soracco | A63B 60/04 |
| 2020/0330834 | A1 * | 10/2020 | Northcutt | A63B 53/045 |
| 2021/0260449 | A1 * | 8/2021 | Cleghorn | A63B 60/04 |
| 2021/0275884 | A1 * | 9/2021 | Frederickson | A63B 53/06 |
| 2023/0277902 | A1 * | 9/2023 | Nakamura | A63B 53/04 |

* cited by examiner

WEDGE SLIDER WEIGHT FOR GOLF CLUB HEAD

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a weight for a golf club head that can be adjusted along a continuous channel and that has interchangeable components that can be stored at different locations on the golf club head.

Description of the Related Art

The ability to adjust center of gravity location and weight in the head of driving clubs is useful for controlling performance of the golf club. The prior art includes several different solutions for adjustable weighting, including movable or slidable weights. While increasing the number of positions where a weight can be moved may be desirable for a golfer, the structures necessary to support these positions (ribs, support struts, etc.) can use up discretionary mass, interfere with the sound of the club head upon impact with a golf ball, and/or interfere with swing by interacting with turf during use. The structure of the weight itself also complicates the problem, as the parts used to create a movable or slidable weight are typically made from monolithic metal pieces. Therefore, there is a need for an adjustable weighting mechanism with a structural support system that does not use up significant discretionary mass or unnecessarily affect sound.

BRIEF SUMMARY OF THE INVENTION

One aspect of the present invention is a golf club head comprising a body with a channel and a weight assembly therein.

One aspect of the present invention is a golf club head comprising a body and a weight assembly. The body comprises a sole wall, a crown wall, and a face wall, the sole wall having a channel. The channel has an upper section having a first width and a lower section having a second width wherein the second width is greater than the first width, the channel having interior walls. The weight assembly is placed within the channel. The weight assembly comprises a screw, a first wedge, a second wedge, and a nut component having a main member, a first wing component and a second wing component. The main member has a partially open bottom and a partially threaded top opening. The first wedge and the second wedge are positioned within the opening of the main member. The screw is configured for placement within the partially threaded top opening of the main member. The first wedge and the second wedge are designed to convert a downward force of the screw into a side force to push the first wedge and the second wedge outward to lock the weight assembly within the channel by the first wedge and second wedge extending force against the interior channels walls of the lower section of the channel.

Yet another aspect of the present invention is a golf club head comprising a face component composed of a metal material, a central body and a weight assembly. The central body comprises a sole wall and a crown wall, the sole wall having a channel. The channel has an upper section having a first width and a lower section having a second width. The second width is greater than the first width. The channel has interior walls. The weight assembly is placed within the channel. The weight assembly comprises a screw, a first wedge, a second wedge, and a nut component having a main member, a first wing component and a second wing component. The main member has a partially open bottom and a partially threaded top opening. The first wedge and the second wedge are positioned within the opening of the main member. The screw is configured for placement within the partially threaded top opening of the main member. The first wedge and the second wedge are designed to convert a downward force of the screw into a side force to push the first wedge and the second wedge outward to lock the weight assembly within the channel by the first wedge and second wedge extending force against the interior channels walls of the lower section of the channel.

Yet another aspect of the present invention is a golf club head comprising a face component composed of a metal material, a central body and a weight assembly. The central body comprises a sole wall and a crown wall. The sole wall has a pocket. The pocket has an upper section having a first width and a lower section having a second width wherein the second width is greater than the first width. The pocket has interior walls. The weight assembly is placed within the pocket. The weight assembly comprises a screw, a first wedge, a second wedge, and a nut component having a main member, a first wing component and a second wing component. The main member has a partially open bottom and a partially threaded top opening. The first wedge and the second wedge are positioned within the opening of the main member. The screw is configured for placement within the partially threaded top opening of the main member. The first wedge and the second wedge are designed to convert a downward force of the screw into a side force to push the first wedge and the second wedge outward to lock the weight assembly within the pocket by the first wedge and second wedge extending force against the interior walls of the lower section of the pocket.

Yet another aspect of the present invention is a golf club head comprising a body and a weight assembly. The body comprises a sole wall, a crown wall, and a face wall, the sole wall having a pocket. The pocket has an upper section having a first width and a lower section having a second width wherein the second width is greater than the first width. The pocket has interior walls. The weight assembly is placed within the pocket. The weight assembly comprises a screw, a first wedge, a second wedge, and a nut component having a main member, a first wing component and a second wing component. The main member has a partially open bottom and a partially threaded top opening. The first wedge and the second wedge are positioned within the opening of the main member. The screw is configured for placement within the partially threaded top opening of the main member. The first wedge and the second wedge are designed to convert a downward force of the screw into a side force to push the first wedge and the second wedge outward to lock the weight assembly within the pocket by the first wedge and second wedge extending force against the interior walls of the lower section of the pocket.

Yet another aspect of the present invention is a weight assembly for a golf club head. The weight assembly comprises a screw, a first wedge, a second wedge, and a nut component. The nut component has a main member, a first wing component and a second wing component. The main member has a partially open bottom and a partially threaded top opening. The first wedge and the second wedge are positioned within the opening of the main member. The screw is configured for placement within the partially threaded top opening of the main member. The first wedge and the second wedge are designed to convert a downward force of the screw into a side force to push the first wedge and the second wedge outward to lock the weight assembly within a channel of a golf club head by the first wedge and second wedge extending force against the interior walls of the channel.

The weight assembly preferably has a mass ranging from 1 gram to 25 grams. The weight assembly is preferably composed of metal selected from the group consisting of aluminum, tungsten, steel, titanium alloy, brass, silver, gold, nickel and copper. The weight assembly preferably has a height ranging from 0.25 inch to 1.0 inch, and a width ranging from 0.5 inch to 2.0 inches. The screw preferably has a length ranging from 0.25 inch to 1.5 inches.

The screw preferably has a top and a threaded bottom section. The channel preferably extends from a heel side of the sole wall to a toe side of the sole wall. The body is preferably composed of a titanium alloy or an iron alloy. The golf club head is preferably a driver, fairway wood or hybrid. The weight assembly further comprises an O-ring around the nut component.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
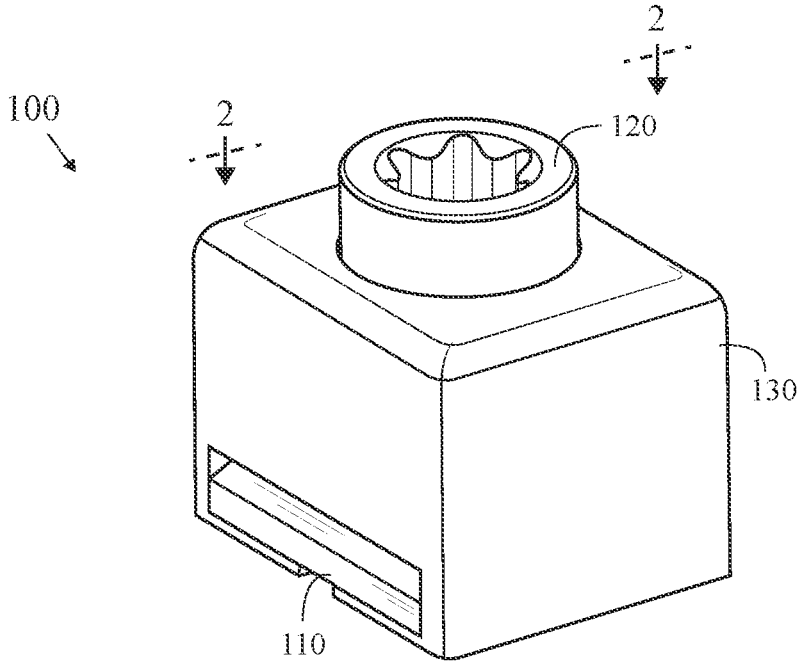
FIG. 1 is a top perspective of a weight assembly.
Figure 2:
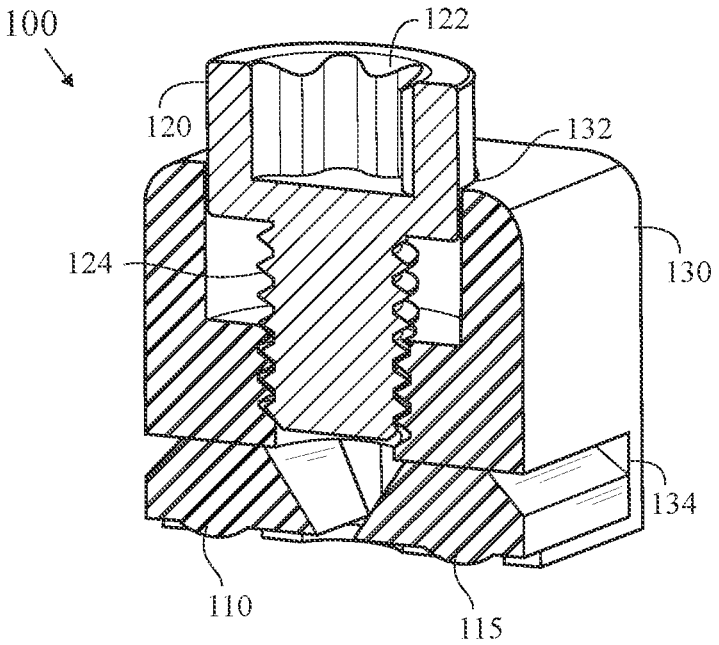
FIG. 2 is a cross-sectional view of the weight assembly shown in FIG. 1.

Historically, adjustable weighting systems are composed of a top weight with a counterbore, socket cap screw, and a nutplate. The counterbore of the topweight receives the screw head while the threads of the screw engage with the nutplate. The assembly clamps down on rails, a part of the cast body, to form a joint. Due to the height of the screw head, these systems have a large envelope. The size of the envelope requires a large recess in the cast body leading to a greater amount of fixed weight within the track system that cannot be adjusted which negatively affects the mass properties (CGx,y,z) of the driver. Additionally, the structures required to hold previous adjustable weighting systems cause problems with acoustics and require ribs in order to dampen unwanted frequencies that are excited during impact. If removing the slider from the track is desired, what is left will be three individual components that could potentially be lost.

The present invention provides the same infinite level of adjustability with the rail track system (within the range of the track while taking up a smaller footprint and increasing the ratio of movable weight (discretionary weight) to fixed weight within the system) so that mass properties stay competitive with a non-weight track version of the same head. Additionally, the track, which is part of the body that receives the weight, shall have a stiffer structure eliminating the need for acoustic ribs.

A preferred embodiment of the present invention is shown in FIGS. 30-37.

The golf club head 10 comprises a body 20 with a channel 40 and a pair of grooves 50, 55 running parallel, the grooves are sized to receive wedges 110, 115. The channel 40 comprises a groove 45 in the sidewall 42 to receive a protrusion 135 on the body.

As shown in FIGS. 31-33 and FIG. 36, the adjustable weight assembly 100 is comprised of a body 130, two wedges 110, 115, a set screw 120 and an o-ring 150. The body 130 has an opening 132 though the top with internal thread receptors, an opening 134 on either one side or both, and a protrusion 135 that engages with the track 40. The set screw 120 is comprised of a torx drive 122, a threaded portion 124 that engages the body 130, and a conical tip 125 opposite the drive 122. An o-ring retainer 150 is used to keep the wedges from falling out when the screw is removed.

The tongue and groove design keeps the slider weight assembly 100 within the track 40 when the wedges 110, 115 are not engaged.

Figure 40:
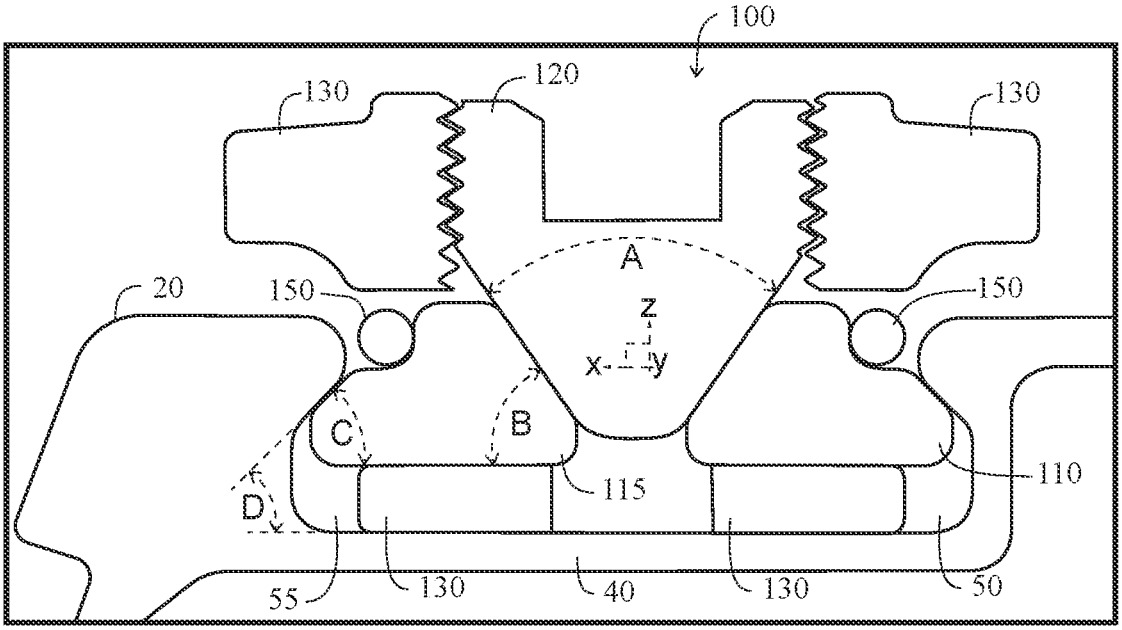
FIG. 40 is a block diagram showing the angles of the track, the wedges, and the screw.

In reference to FIG. 40, the wedges 110, 115 are comprised of an angled portion B that engages the set screw 120, an angled portion C that engages the track 40, either a flat or curved portion on the bottom that engages the body 130, and may contain a tab that engages with the o-ring or a retaining bump on the bottom or top surface.

The conical angle A of the screw 120 is between 30-110° preferably between 50-90°. Angle B of the wedges 110, 115 is between 30-75°, preferably between 40-65°. Angle C of the wedges 110, 115 is between 0-50°, preferably between 20-50°, and more preferably between 40-50°. Angle D of the track 40 is between 0-50°, preferably between 20-50°, and more preferably between 40-50°.

FIGS. 1-12 show another embodiment of the weight assembly. The weight assembly 100 is comprised of a nut 130 (also referenced as body), two wedges 110, 115, and a set screw 120. The nut 130 has an opening 132 though the top with internal thread receptors, and an opening 134 on either one side or both. The set screw 120 is comprised of a torx drive 122 and a threaded portion 124 that engages the body 130.

Figure 3:
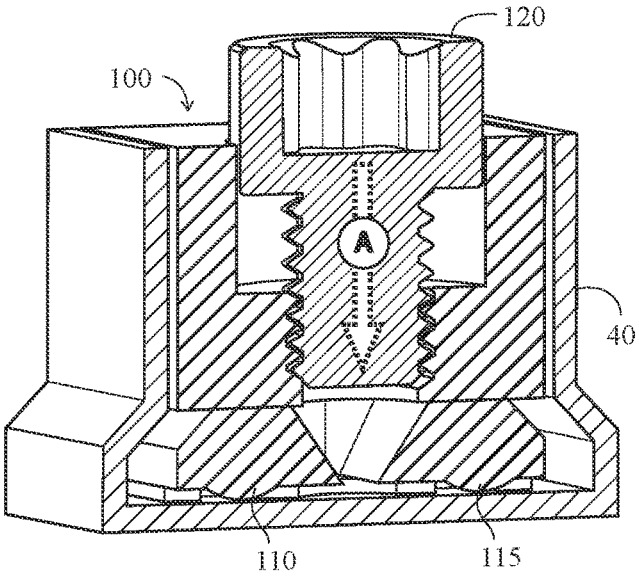
FIG. 3 is a cross-sectional view of the weight assembly within a channel showing the tightening of a screw which exerts a downward force of a pair of wedges.
Figure 4:
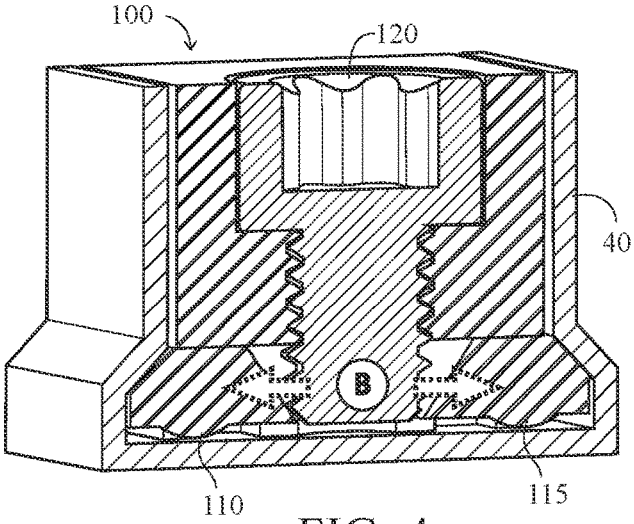
FIG. 4 is a cross-sectional view of the weight assembly within a channel showing the tightening of a screw which exerts a downward force of a pair of wedges which convert the downward force to an outward (side) force.
Figure 5:
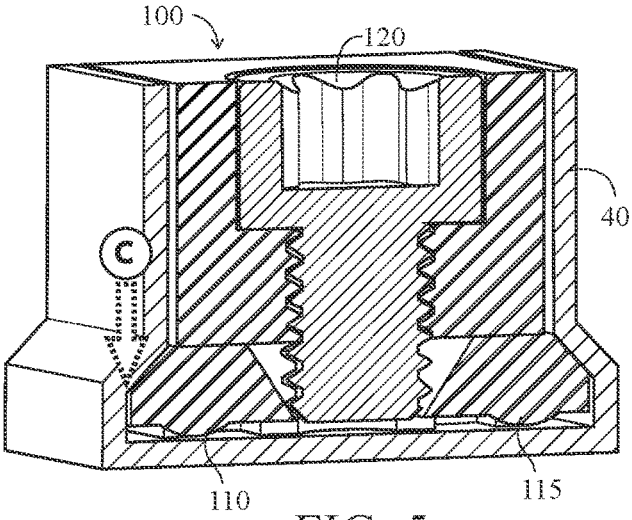
FIG. 5 is a cross-sectional view of the weight assembly within a channel showing the tightening of a screw which exerts a downward force of a pair of wedges which convert the downward force to an outward (side) force thereby locking the weight assembly within the channel.

FIGS. 3-5 show the sequence of events of the weight assembly 100 within a channel (also referenced as track) 40. In FIG. 3, tightening the screw 120 exerts a downward force A on a pair of wedges 110, 115. In FIG. 4, the inner wedges 110, 115 convert the downward force A to an outward (side) force B. In FIG. 5, the channel 40 applies reaction force C downwards onto the outer sides of the wedges 110, 115, locking it into place within the channel 40.

Figure 6:
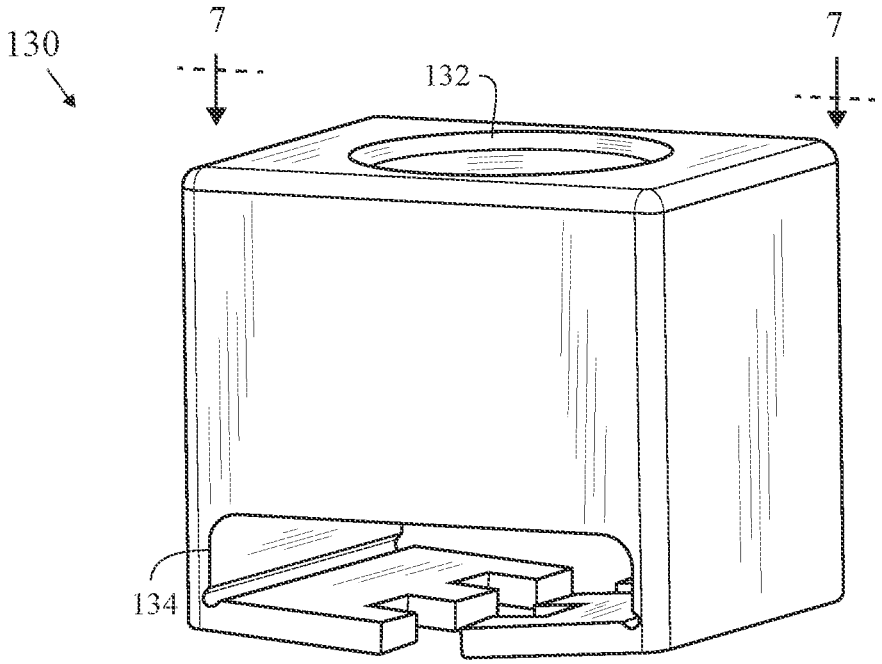
FIG. 6 is a view of a nut component of a weight assembly.
Figure 7:
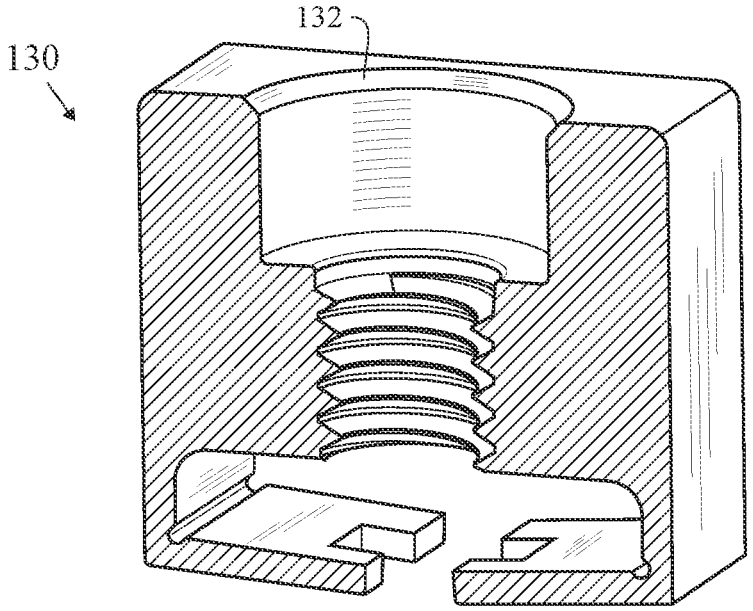
FIG. 7 is a cross-sectional view of the nut component of a weight assembly of FIG. 6.
Figure 8:
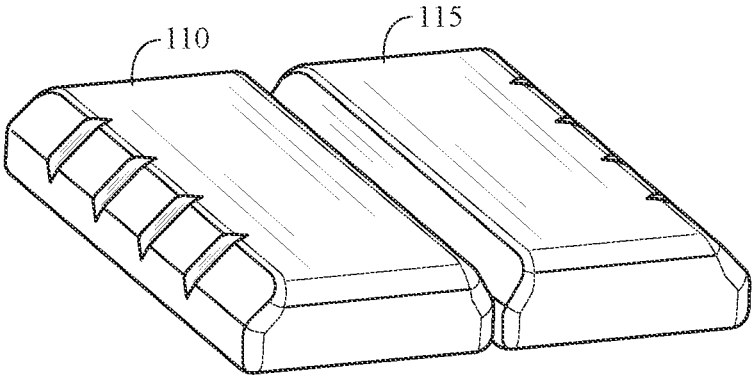
FIG. 8 is a top perspective view of a pair of wedges of a weight assembly.
Figure 9:
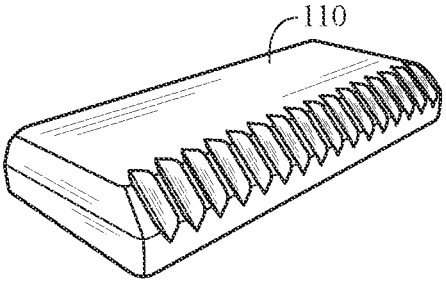
FIG. 9 is a top perspective view of a wedge of a weight assembly.
Figure 10:
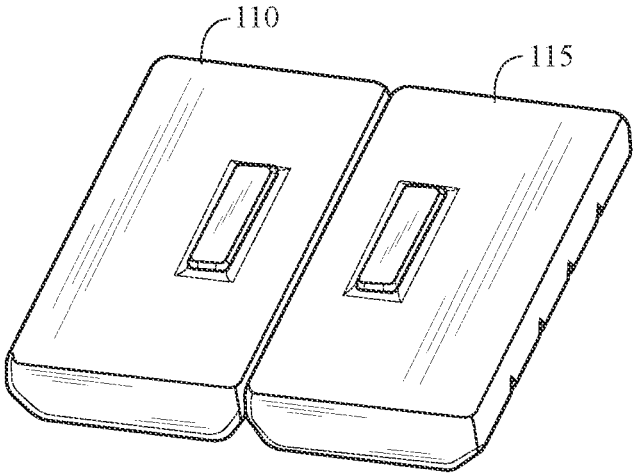
FIG. 10 is a bottom perspective view of a pair of wedges of a weight assembly.
Figure 11:
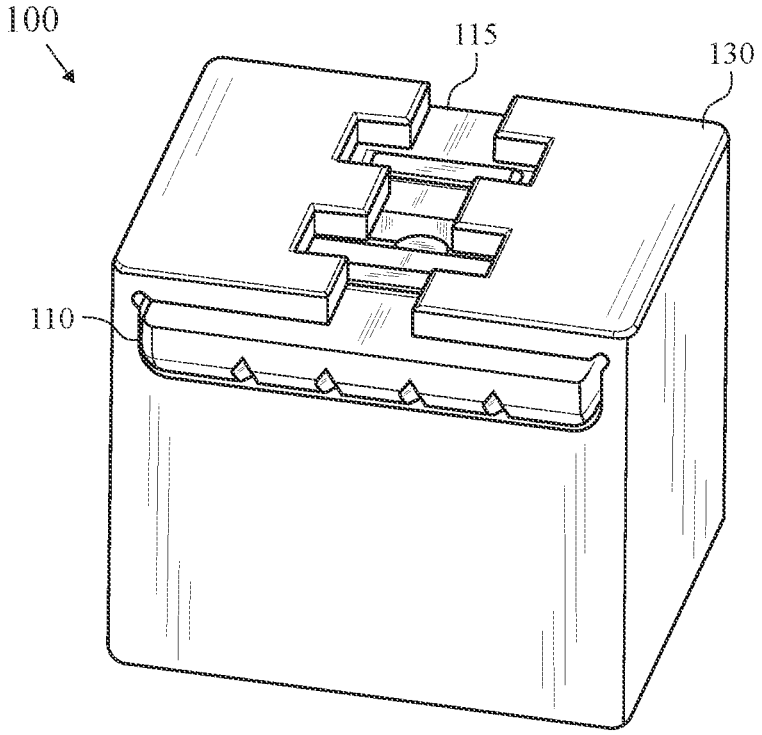
FIG. 11 is a bottom perspective of a weight assembly showing wings of the nut component crimped to encapsulate the wedges.

FIGS. 6-11 show components of the assembly process of the weight assembly 100. In FIG. 6, the nut 130, also referenced herein as body, is mimed with the wings partially open. Two wedges 110, 115, shown in FIGS. 8-10, are placed on the nut 130. In FIG. 11 the wings of the nut 130 are crimped to encapsulate the wedges 110, 115.

Figure 12:
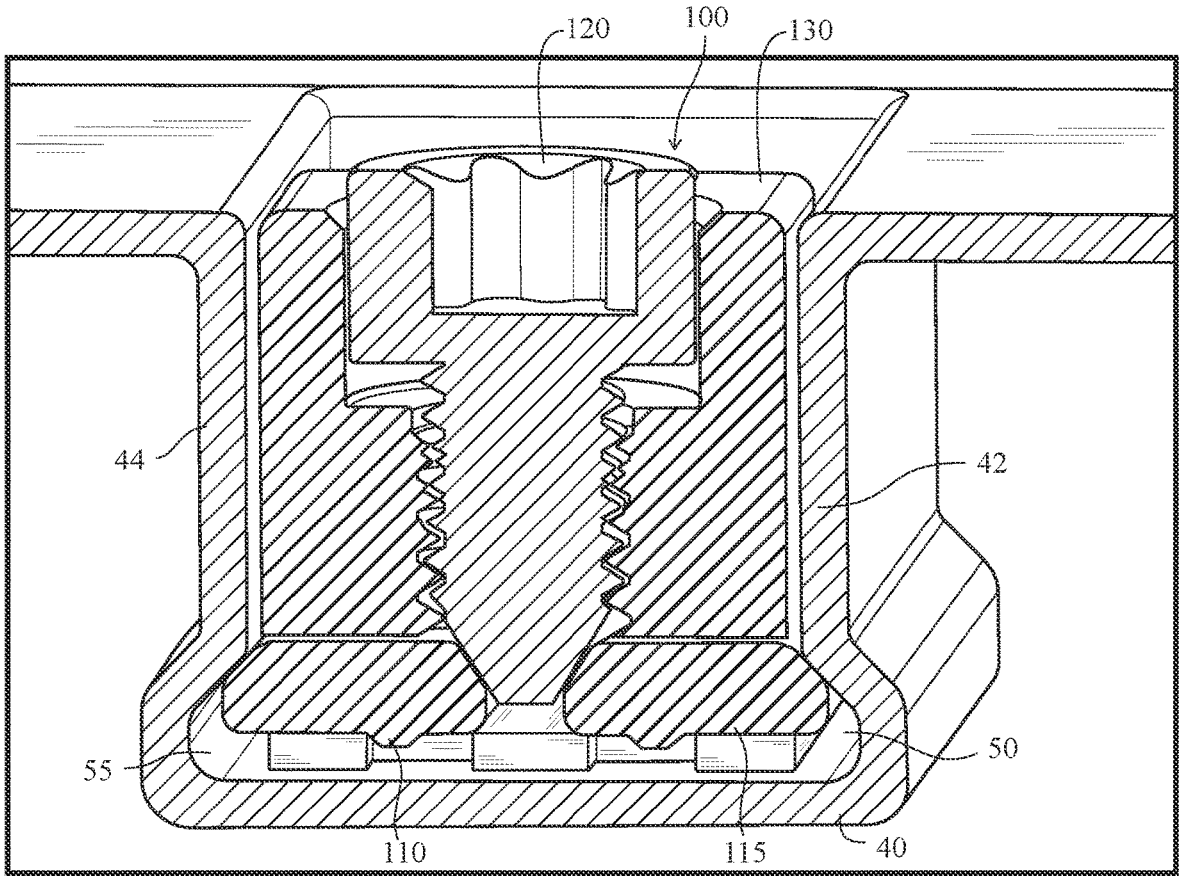
FIG. 12 is a cross-sectional view of the weight assembly within a channel.

FIG. 12 is a cross-sectional view showing the complete weight assembly 100 within a channel 40, also referenced herein as track.

Figure 13:
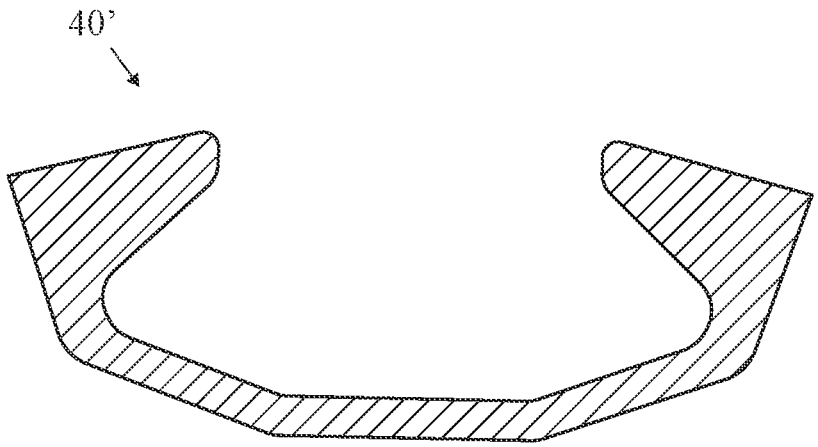
FIG. 13 PRIOR ART
FIG. 13 is a cross-sectional view of a prior art track.
Figure 14:
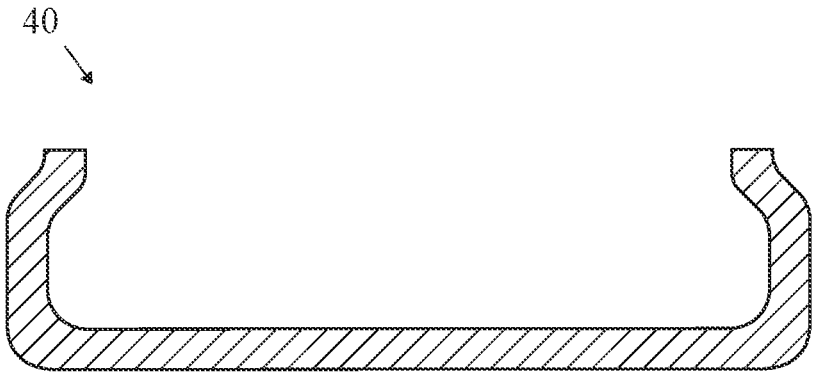
FIG. 14 is a cross-sectional view of a track.

FIGS. 13-14 show the difference in the prior art track 40' and the track 40 of the present invention. The cross-sectional area of the prior art's track 40' is 0.0345 $in^2$ and the weight per inch of track is 2.52 g. The cross-sectional area of the present invention's track 40 is 0.0202 $in^2$ and the weight per inch of track is 1.47 g. The weight savings is 42%. With the new track design, a 3.5" track can be utilized for the same weight as a 2" track with the prior art design.

Figure 15:
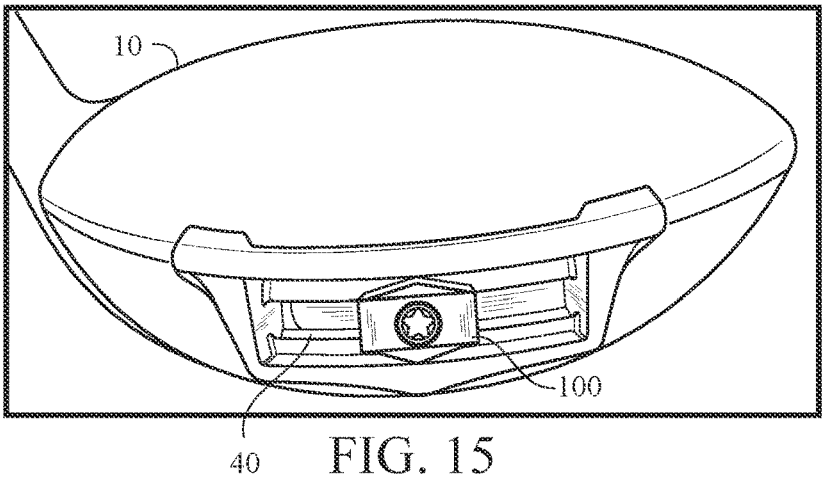
FIG. 15 PRIOR ART
FIG. 15 is a rear perspective view of a club head with a prior art track and weight assembly.
Figure 16:
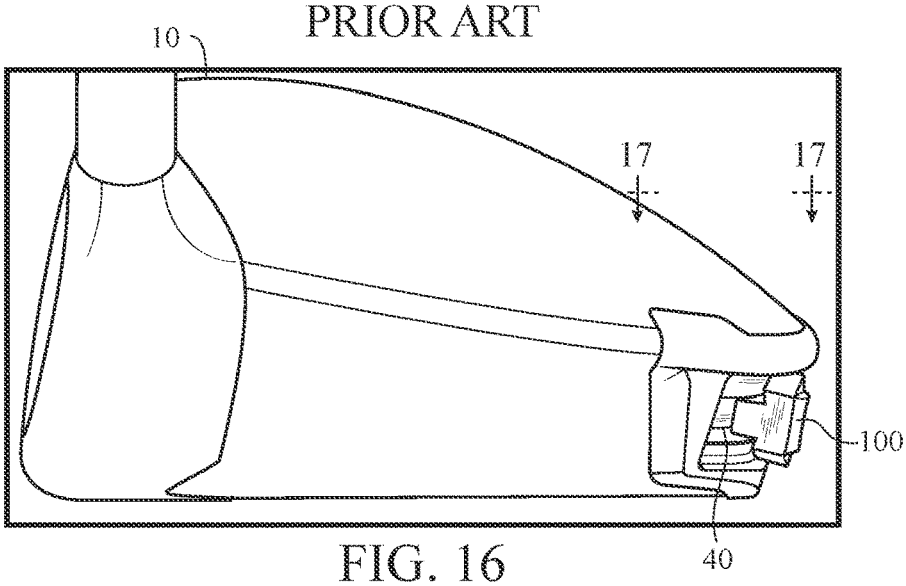
FIG. 16 PRIOR ART
FIG. 16 is a side perspective view of a club head with a prior art track and weight assembly.
Figure 17:
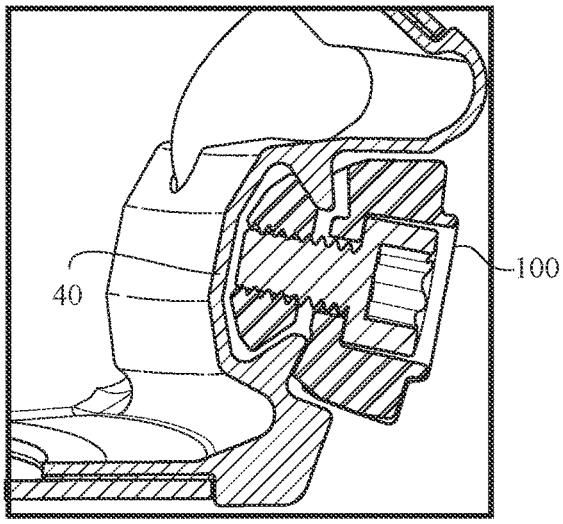
FIG. 17 PRIOR ART
FIG. 17 is a cross-sectional view of the prior art track and weight assembly shown in FIG. 16.

FIGS. 15-17 illustrate the prior art track 40 and weight assembly 100.

Figure 18:
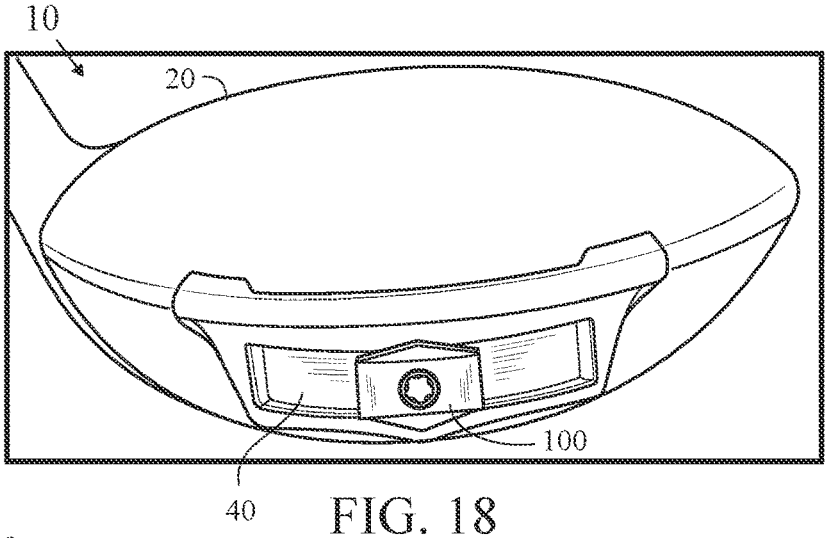
FIG. 18 is a rear perspective view of a club head with a weight assembly.
Figure 19:
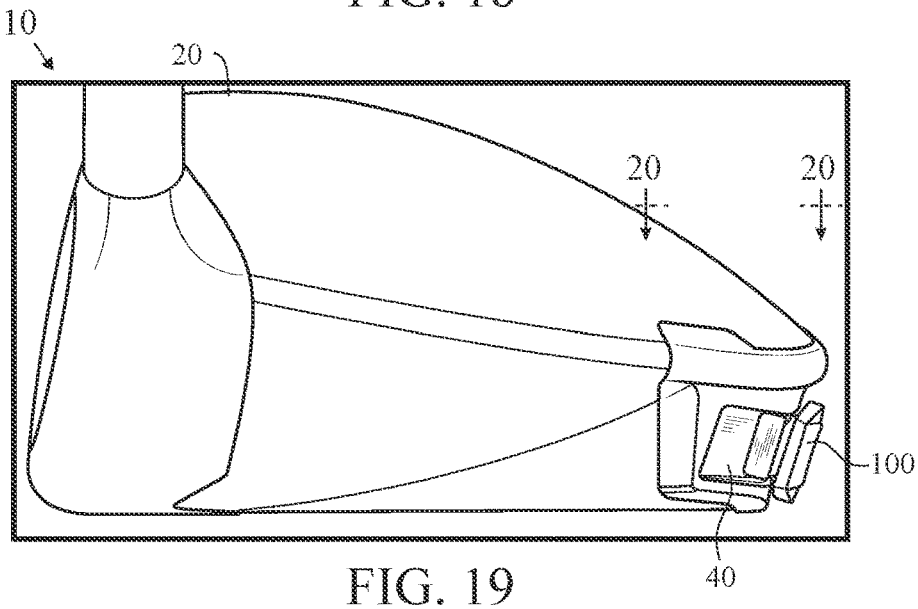
FIG. 19 is a side perspective view of a club head with a weight assembly.
Figure 20:
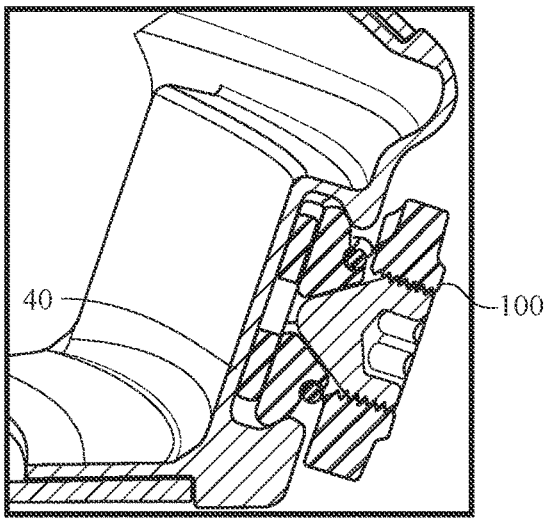
FIG. 20 is a cross-sectional view of the weight assembly shown in FIG. 19.

FIGS. 18-20 illustrate the new track 40 and weight assembly 100. The back cap is 3.7 grams lighter than the prior art.

Figure 21:
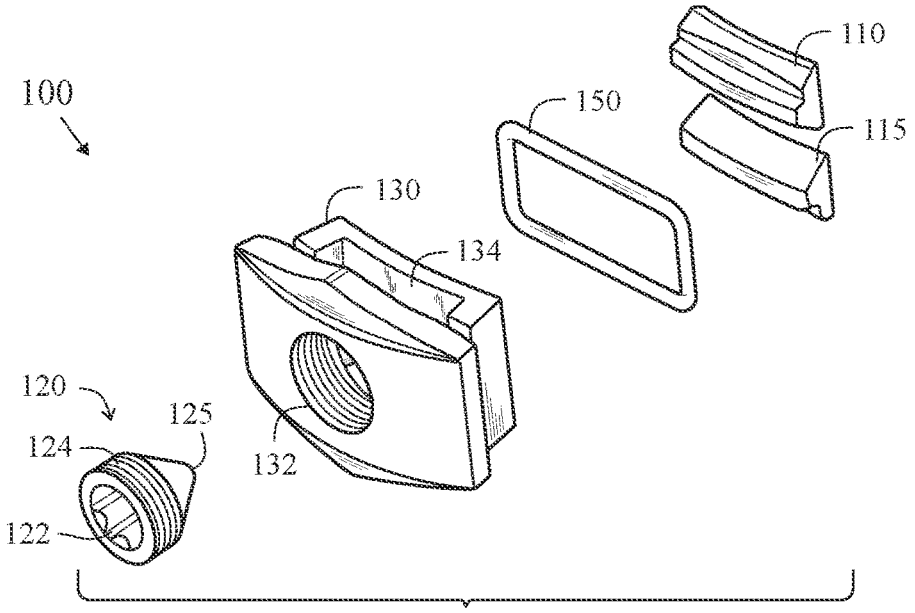
FIG. 21 is an exploded view of a slider weight assembly.

FIG. 21 shows another embodiment of the weight assembly 100. The slider weight assembly 100 is comprised of a body 130, two wedges 110, 115, a set screw 120 and an o-ring 150. The body 130 has an opening 132 though the top with internal thread receptors, and an opening 134 on either one side or both. The set screw 120 is comprised of a torx drive 122, a threaded portion 124 that engages the body, and a conical tip 125 opposite the drive.

Figure 22:
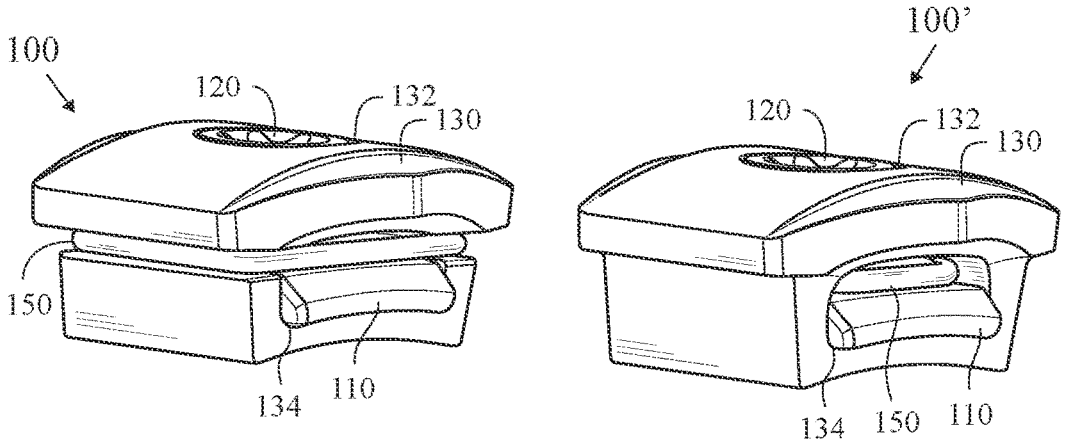
FIG. 22 is a front perspective view of two embodiments of the weight assembly.
Figure 23:
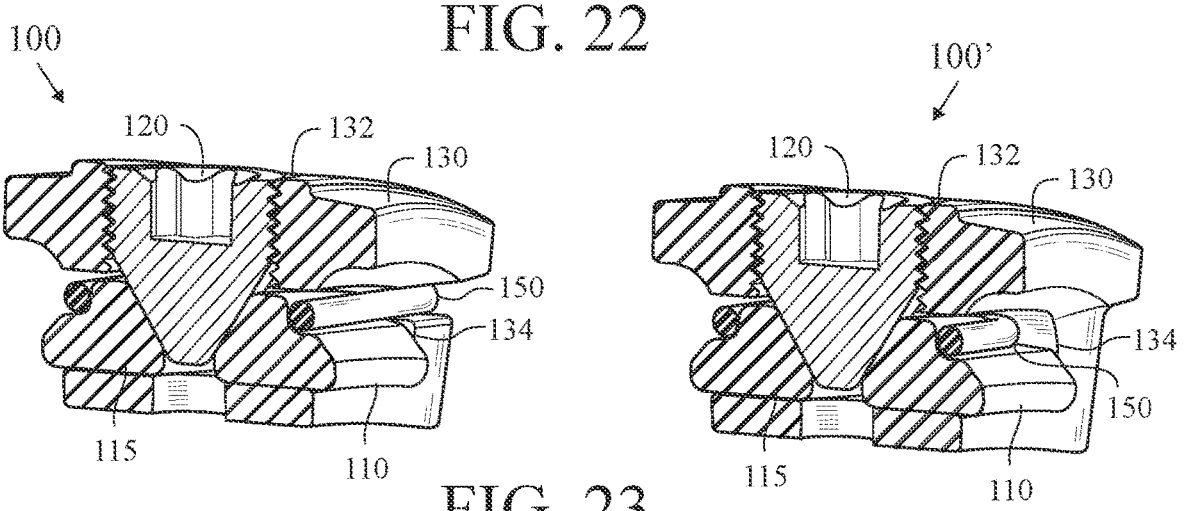
FIG. 23 is a cross-sectional view of two embodiments of the weight assembly.

An alternative embodiment 100' of the weight assembly 100 of FIG. 21 has the o-ring inside of the body 130 to retain the wedges 110, 115, as shown in FIGS. 22-23. The o-ring 150 wraps around the wedges 110, 115 to retain them.

Figure 24:
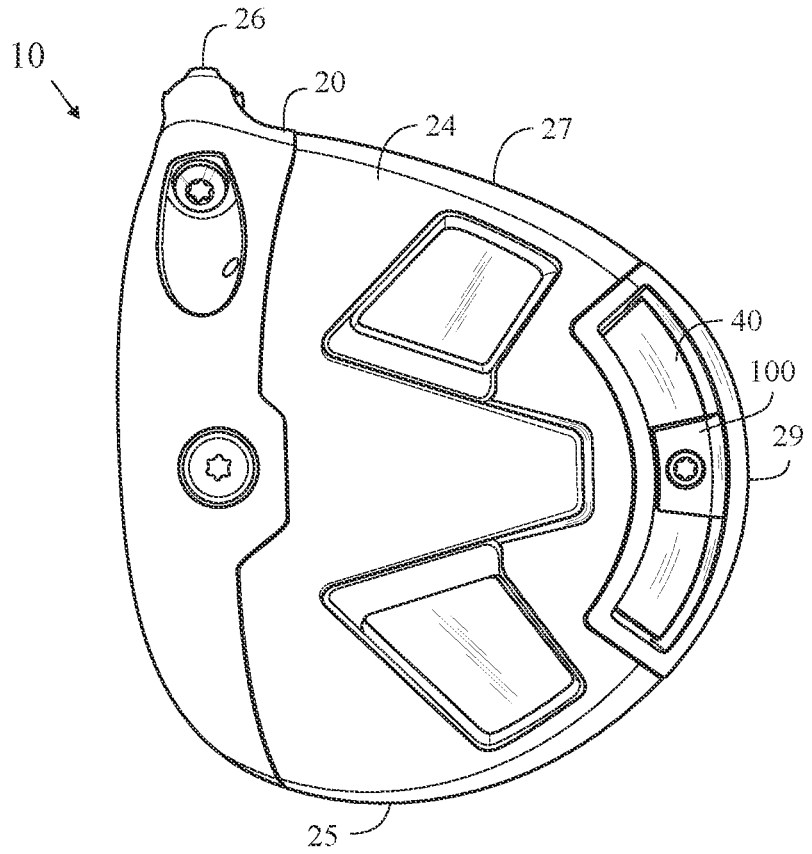
FIG. 24 is a bottom view of a club head with a weight assembly.
Figure 25:
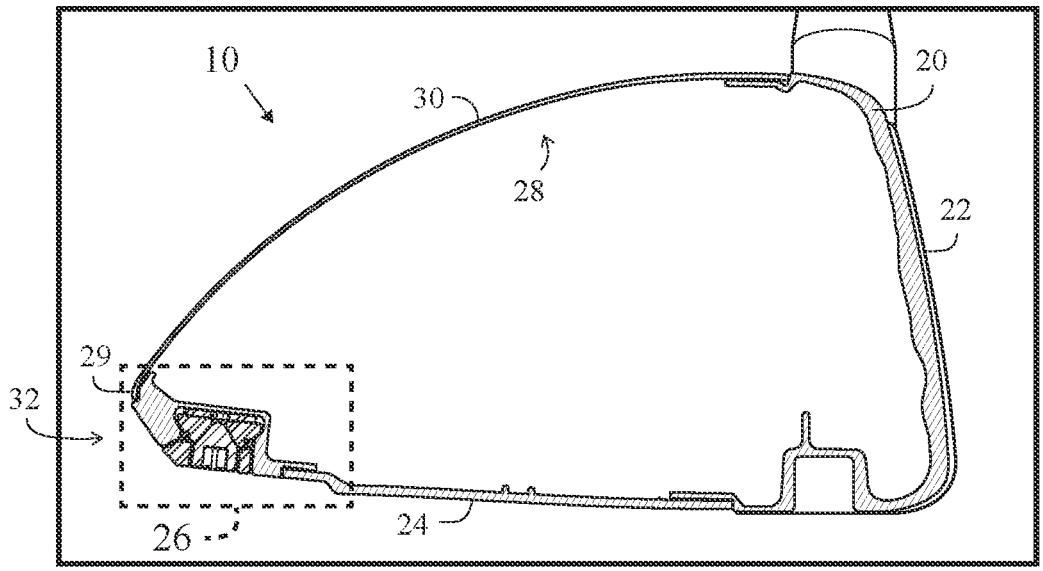
FIG. 25 is a cross-sectional view of a club head with a weight assembly.
Figure 26:
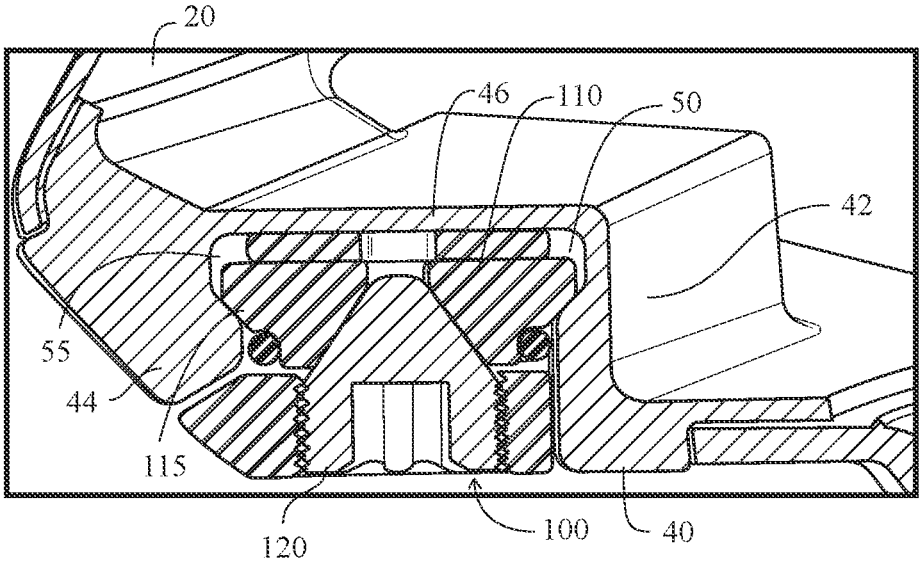
FIG. 26 is a detailed cross-sectional view of the weight assembly of the club head shown in FIG. 25.

FIGS. 24-26 show yet another embodiment of the weight assembly 100 in the track 40 of a golf club head 10. The golf club head 10 comprises a metal body 20 with a face 22, a sole 24, a heel side 25, a hosel 26, a toe side 27, an upper opening 28, and a rear side 29, and a composite crown 30 that is adhered to the body 20 and covers the upper opening 28. A channel 40 is disposed at a rear side 29 of the sole 24, near an edge region 32 where the crown 30 connects to the sole 24, but may, in alternative embodiments, be disposed in the sole 24 proximate the face 22, within a side or ribbon portion of the golf club head 10, or in the crown 30. The track 40, which preferably has any or all of the characteristics disclosed in U.S. Pat. No. 9,675,856, extends from the heel side 25 to the toe side 27 of the rear side 29, and has first and second side walls 42, 44, a floor 46, and a pair of grooves 50, 55 running parallel. The grooves receive the wedges 110, 115 which are used as the locking mechanism.

Figure 27:
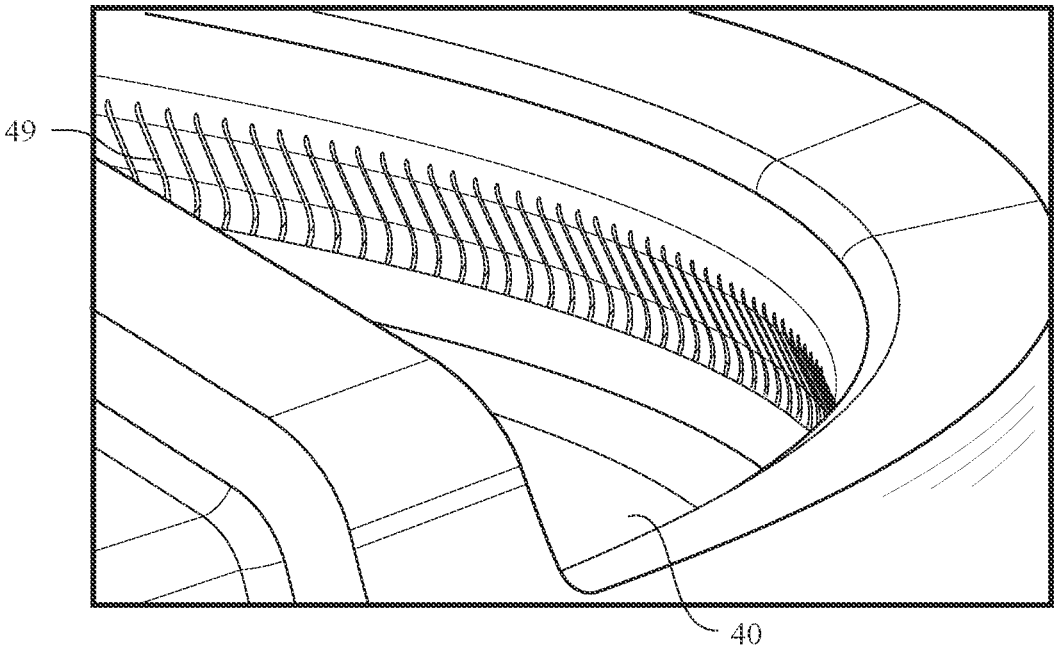
FIG. 27 is a detailed view of the interior of a track.

In FIG. 27, depressions or grooves 49 perpendicular along the length of the track 40 prevent an installed weight 100 from sliding, yet allows the wedges 110, 115 to not get stuck for ease of weight 100 removal. In an alternative embodiment, plating on the wedges 110, 115 and slider body 130 reduce galling and prevents the weight 100 from getting stuck.

Figure 28:
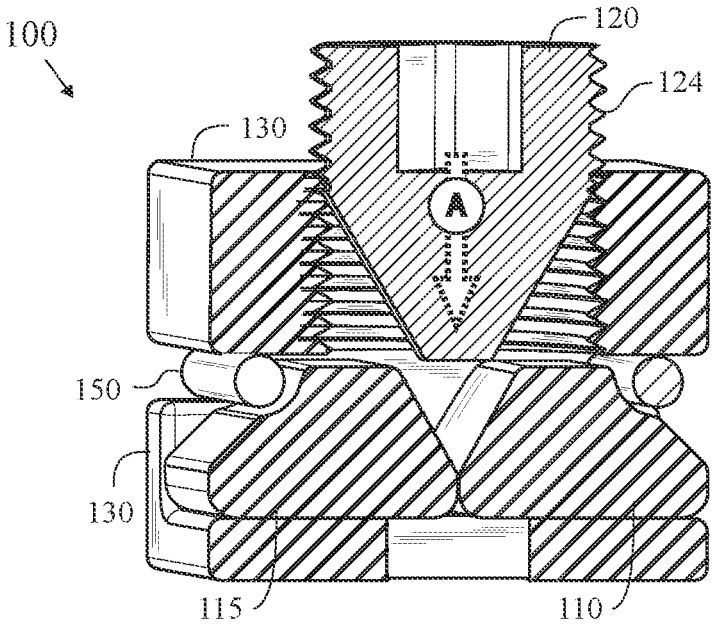
FIG. 28 is a cross-sectional view of a weight assembly.
Figure 29:
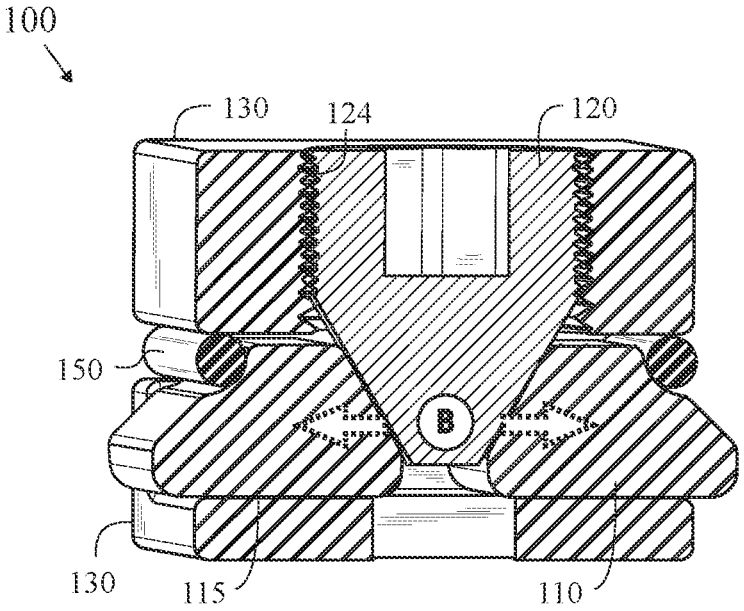
FIG. 29 is a cross-sectional view of the weight assembly showing the tightening of a screw which exerts a downward force of a pair of wedges which convert the downward force to an outward (side) force thereby locking the weight assembly within a track.
Figure 30:
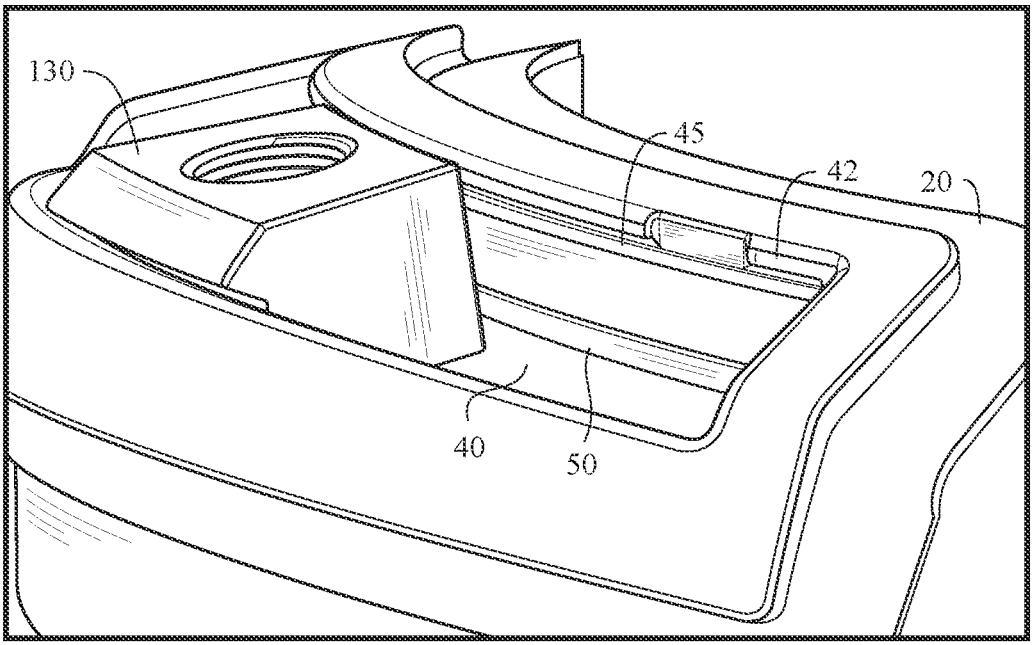
FIG. 30 is a top perspective view of a weight assembly body without the screw inside the track of a golf club head.
Figure 31:
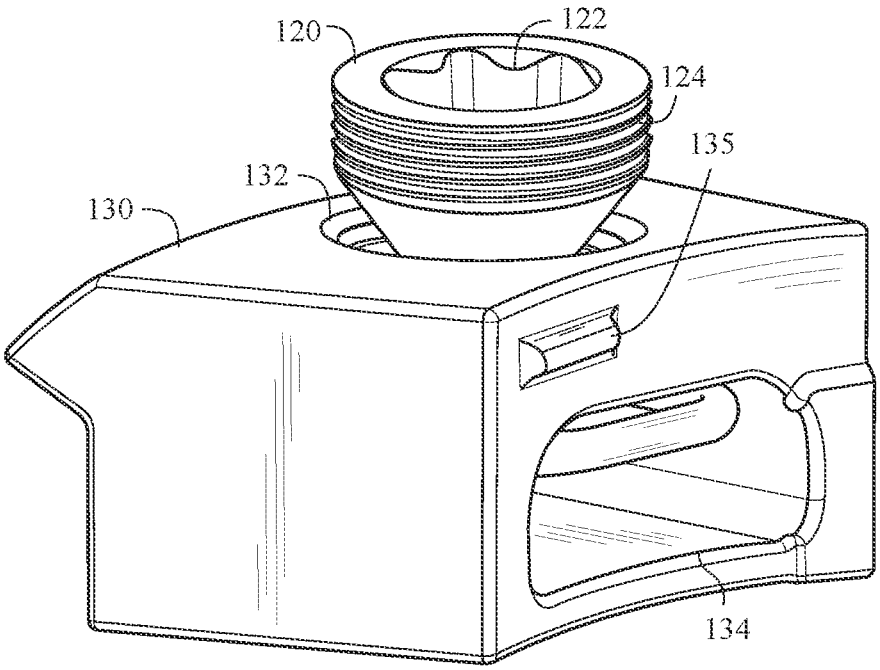
FIG. 31 is a rear perspective view of a weight assembly without the screw and wedges.
Figure 32:
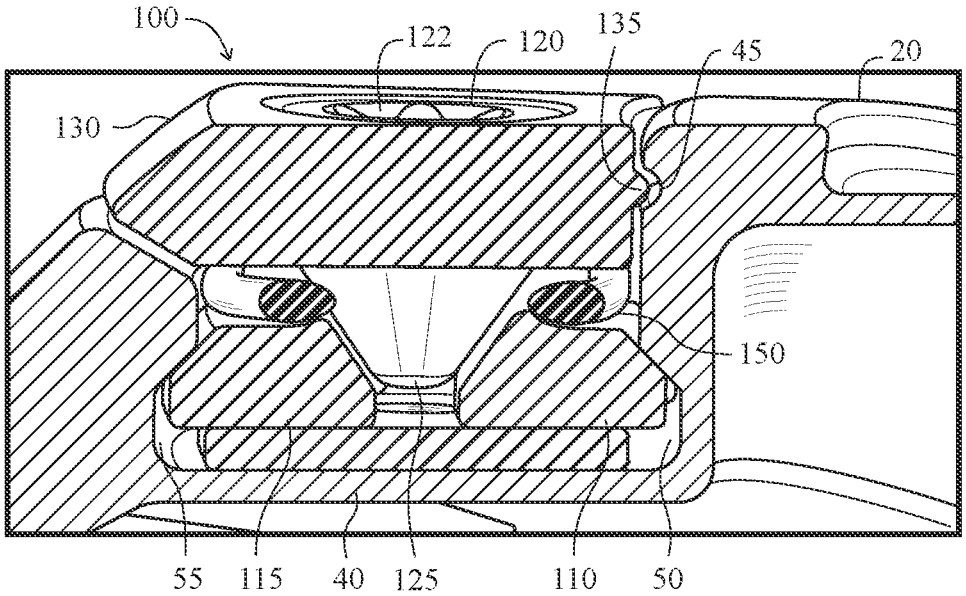
FIG. 32 is a cross-sectional view of a weight assembly and track of a club head.
Figure 33:
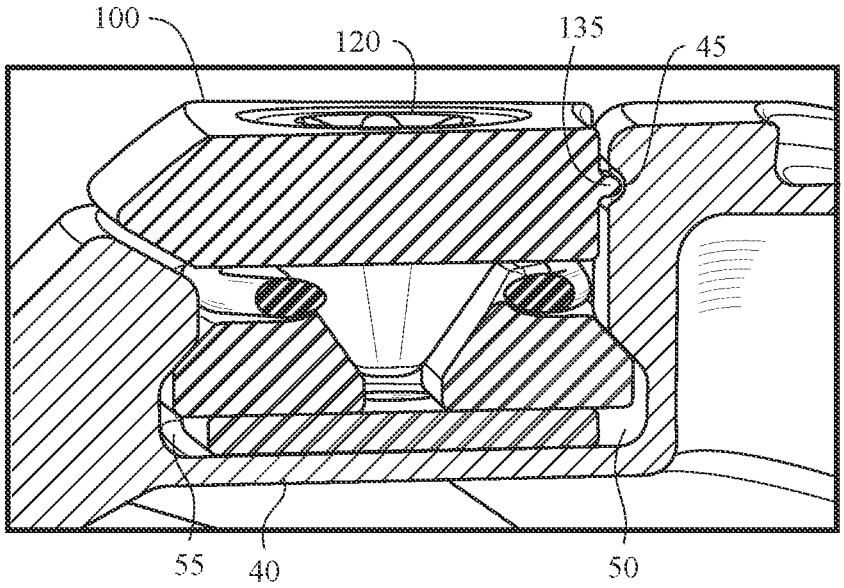
FIG. 33 is a cross-sectional view of a weight assembly engaged with the body and track of a club head.
Figure 34:
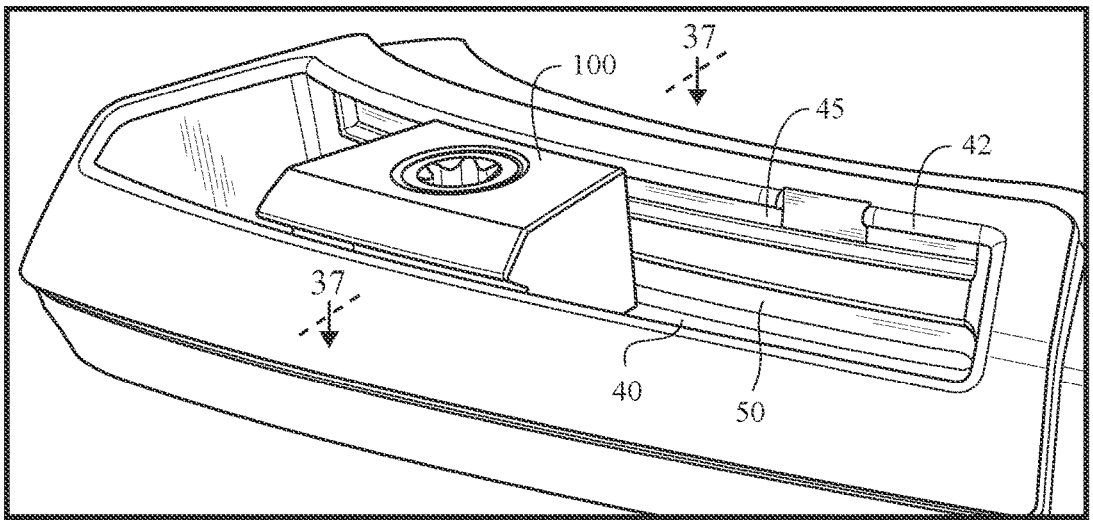
FIG. 34 is a top perspective view of a weight assembly in the track of a golf club head.
Figure 35:
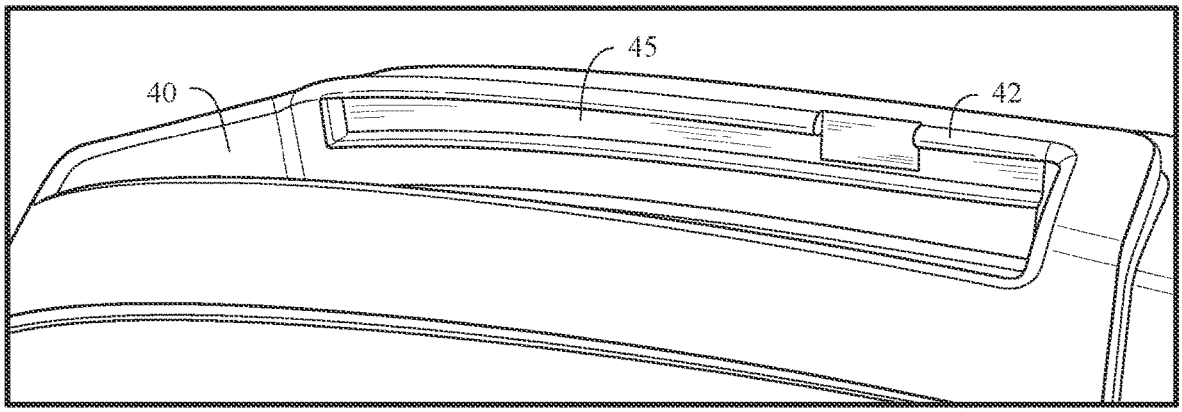
FIG. 35 is a detailed view of the groove of the track.
Figure 36:
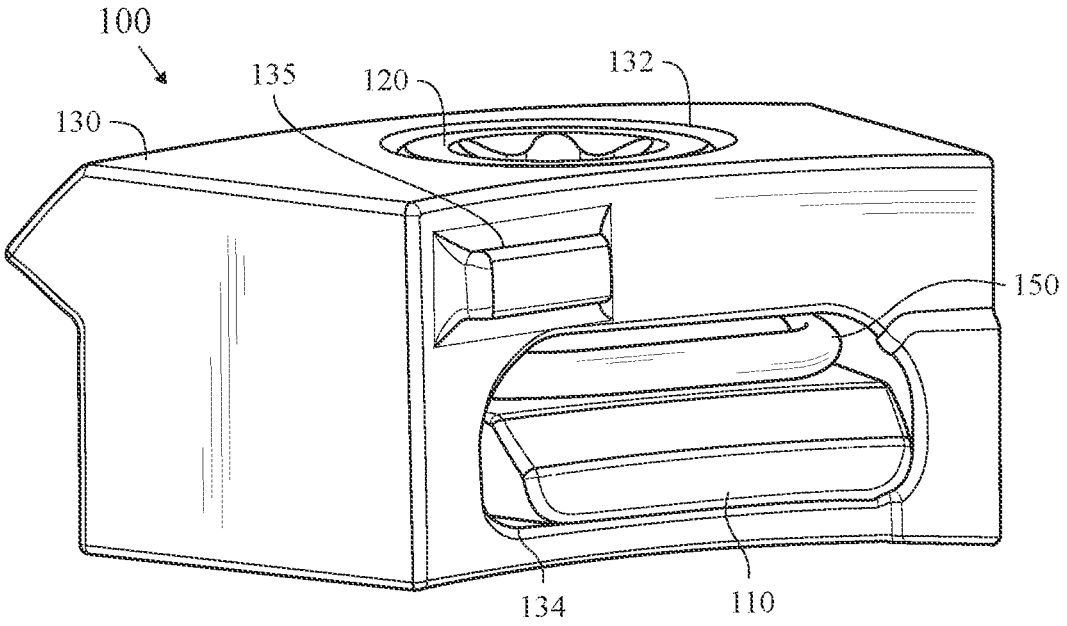
FIG. 36 is a rear perspective view of a weight assembly with a protrusion.
Figure 37:
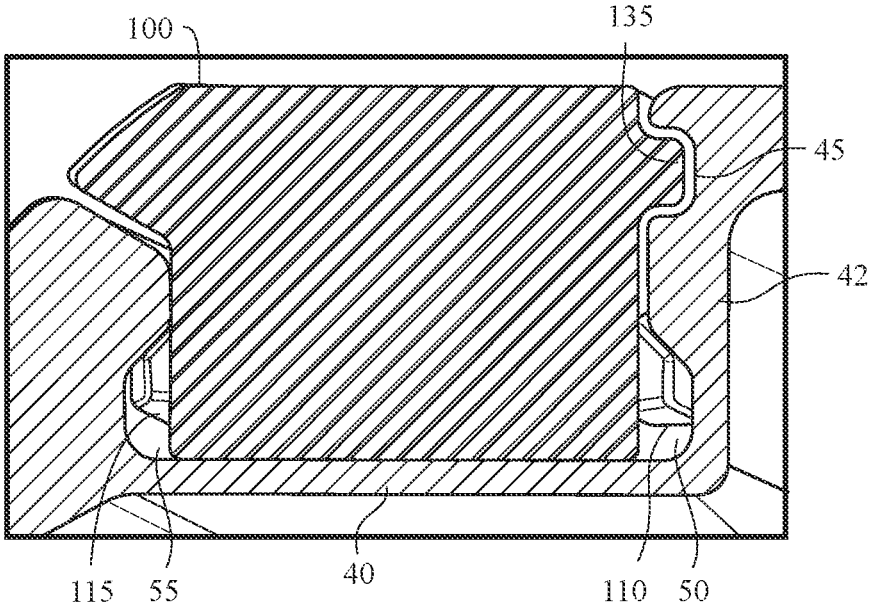
FIG. 37 is a cross-sectional view of the weight assembly with a protrusion in the track of the club head shown in FIG. 34.

In FIG. 28, tightening the screw 120 exerts a downward force A on a pair of wedges 110, 115 in another embodiment of the weight assembly 100. In FIG. 29, the inner wedges 110, 115 convert the downward force A to an outward (side) force B, locking it into place within a track 40.

Figure 38:
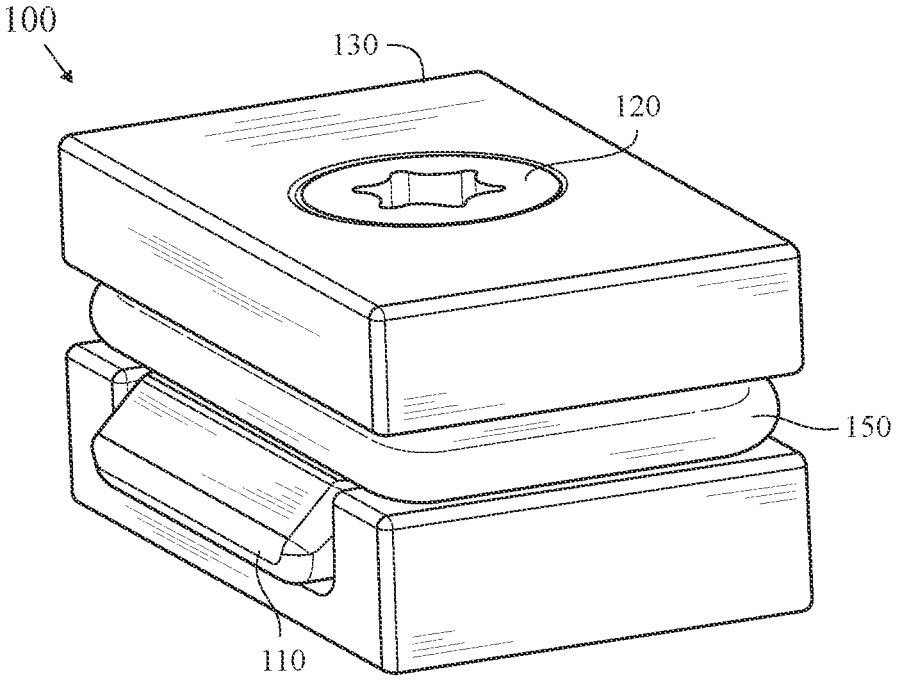
FIG. 38 is a top perspective view of another embodiment of a weight assembly.
Figure 39:
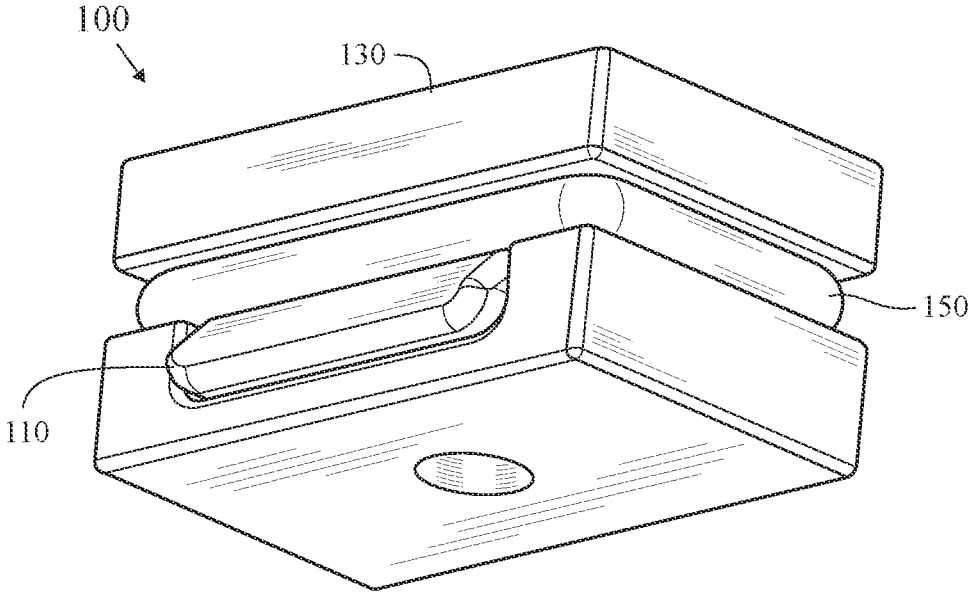
FIG. 39 is a bottom perspective view of another embodiment of a weight assembly.

In FIGS. 38-39, another embodiment of the weight assembly 100 is shown as a rectangular wedge slider. This design seems more viable as it's easier to assemble. The weight assembly 100 comprises of a set screw 120, a nut 130, an o-ring 150, and two wedges 110, 115. The bottom of the nut 130 is enclosed, and an o-ring 150 will hold wedges 110, 115 in place. A set screw is used instead of a socket head screw in order to make the weight more compact if needed.

The design approaches described herein are based on a construction used in a driver head characterized by a composite crown adhesively bonded to a cast titanium body. However, the weighting embodiments disclosed herein can be used with other constructions, including all titanium, all composite, and a composite body with metal face cup. The invention disclosed herein builds and improves upon the golf club head disclosed in U.S. Pat. No. 9,675,856, the disclosure of which is hereby incorporated by reference in its entirety herein. While the structure disclosed in U.S. Pat. No. 9,675,856 is useful and desirable, the weight disclosed therein has excessive mass due to the requirement that it be capable of fitting within different structures within the golf club head, and the overall movable weight system has room for optimization. The weight assembly 100 of the current invention and the structures of the golf club head 10 that receive the weight assembly 100 represent an improvement over this art.

Frederickson et al., U.S. Pat. No. 10,888,751 is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A golf club head comprising:

a body comprising a sole wall, a crown wall, and a face wall, the sole wall having a channel, the channel having an upper section having a first width and a lower section having a second width wherein the second width is greater than the first width, the channel having interior walls;

a weight assembly for placement within the channel, the weight assembly comprising a screw, a first wedge, a second wedge, and a nut component having a main member, a first wing component and a second wing component, the main member having a partially open bottom and a partially threaded top opening, wherein the first wedge and the second wedge are positioned within the opening of the main member, wherein the screw is configured for placement within the partially threaded top opening of the main member, wherein the first wedge and the second wedge are designed to convert a downward force of the screw into a side force to push the first wedge and the second wedge outward to lock the weight assembly within the channel by the first wedge and second wedge extending force against the interior channels walls of the lower section of the channel.

2. The golf club head according to claim 1 wherein the weight assembly has a mass ranging from 1 gram to 25 grams.

3. The golf club head according to claim 1 wherein the weight assembly is composed of metal selected from the group consisting of aluminum, tungsten, steel, titanium alloy, brass, silver, gold, nickel and copper.

4. The golf club head according to claim 1 wherein the weight assembly has a height ranging from 0.25 inch to 1.0 inch, and a width ranging from 0.5 inch to 2.0 inches.

5. The golf club head according to claim 1 wherein the screw has a length ranging from 0.25 inch to 1.5 inches.

6. The golf club head according to claim 1 wherein the screw has a top and a threaded bottom section.

7. The golf club head according to claim 1 wherein the channel extends from a heel side of the sole wall to a toe side of the sole wall.

8. A golf club head comprising:

a body comprising a sole wall, a crown wall, and a face wall, the sole wall having a pocket, the pocket having an upper section having a first width and a lower section having a second width wherein the second width is greater than the first width, the pocket having interior walls;

a weight assembly for placement within the channel, the weight assembly comprising a screw, a first wedge, a second wedge, and a nut component having a main member, a first wing component and a second wing component, the main member having a partially open bottom and a partially threaded top opening, wherein the first wedge and the second wedge are positioned within the opening of the main member, wherein the screw is configured for placement within the partially threaded top opening of the main member, wherein the first wedge and the second wedge are designed to convert a downward force of the screw into a side force to push the first wedge and the second wedge outward to lock the weight assembly within the pocket by the first wedge and second wedge extending force against the interior walls of the lower section of the pocket.

9. The golf club head according to claim 8 wherein the weight assembly has a mass ranging from 1 gram to 25 grams.

10. The golf club head according to claim 8 wherein the weight assembly is composed of metal selected from the group consisting of aluminum, tungsten, steel, titanium alloy, brass, silver, gold, nickel and copper.

11. The golf club head according to claim 8 wherein the weight assembly has a height ranging from 0.25 inch to 1.0 inch, and a width ranging from 0.5 inch to 2.0 inches.

12. The golf club head according to claim 8 wherein the screw has a length ranging from 0.25 inch to 1.5 inches.

13. The golf club head according to claim 8 wherein the screw has a top and a threaded bottom section.

14. A weight assembly for a golf club head, the weight assembly comprising:

a screw;

a first wedge;

a second wedge; and a nut component having a main member, a first wing component and a second wing component, the main member having a partially open bottom and a partially threaded top opening, wherein the first wedge and the second wedge are positioned within the opening of the main member;

wherein the screw is configured for placement within the partially threaded top opening of the main member;

wherein the first wedge and the second wedge are designed to convert a downward force of the screw into a side force to push the first wedge and the second wedge outward to lock the weight assembly within a channel of a golf club head by the first wedge and second wedge extending force against the interior walls of the channel.

15. The weight assembly according to claim 14 wherein the weight assembly has a mass ranging from 1 gram to 25 grams.

16. The weight assembly according to claim 14 wherein the weight assembly is composed of metal selected from the group consisting of aluminum, tungsten, steel, titanium alloy, brass, silver, gold, nickel and copper.

17. The weight assembly according to claim 14 wherein the weight assembly has a height ranging from 0.25 inch to 1.0 inch, and a width ranging from 0.5 inch to 2.0 inches.

18. The weight assembly according to claim 14 wherein the screw has a length ranging from 0.25 inch to 1.5 inches.

19. The weight assembly according to claim 14 wherein the screw has a top and a threaded bottom section.

20. The weight assembly according to claim 14 wherein the weight assembly further comprises an O-ring around the nut component.

* * * * *